US005503276A

United States Patent [19]

Pierce

[11] Patent Number: 5,503,276

[45] Date of Patent: Apr. 2, 1996

[54] SPACE-SAVER HANDGUN STAND

[76] Inventor: Danny L. Pierce, Rt. 12, Box 637, Lenoir, N.C. 28645

[21] Appl. No.: 292,252

[22] Filed: Aug. 18, 1994

[51] Int. Cl.[6] ..... A47F 7/00

[52] U.S. Cl. ..... 211/64; 211/59.1; 42/94; 248/309.2; 248/297.21

[58] Field of Search ..... 211/64, 208, 59.1, 211/103.105.1; 248/309.1., 297.2, 225.1; 42/94

[56] References Cited

U.S. PATENT DOCUMENTS

| | | | |
|---|---|---|---|
| D. 310,302 | 9/1990 | Southard | D3/38 |
| 945,520 | 1/1910 | Greenwood | 211/64 X |
| 2,939,587 | 6/1960 | Kondziolka | 211/64 |
| 3,031,069 | 4/1962 | Hirsch | 211/64 X |
| 3,468,427 | 9/1969 | Leslie | 211/64 |
| 3,468,508 | 9/1969 | Huver | 248/314 |
| 4,174,042 | 11/1979 | Fair | 211/64 X |
| 4,198,026 | 4/1980 | Capolupo | 211/64 X |
| 4,971,202 | 11/1990 | Reinfried, Jr. et al. | 211/64 |
| 4,986,427 | 1/1991 | Law et al. | 211/64 |
| 5,143,227 | 9/1992 | Schubert | 211/64 |
| 5,188,328 | 2/1993 | Thompson | 211/64 X |

*Primary Examiner*—Robert W. Gibson, Jr.
*Attorney, Agent, or Firm*—David L. Baker; Rhodes & Ascolillo

[57] ABSTRACT

A stand for storing multiple handguns that includes a base and a vertical panel perpendicular to the base. The vertical panel contains a number of slots with a follower behind the panel and studs extending through the panel to engage a threaded cavity in the follower. The stud and follower slide in the slot and are locked in place by a stop ring on the stud. The barrel of a handgun slides over the stud and the heel of the grip may rest on the base.

7 Claims, 2 Drawing Sheets

SPACE-SAVER HANDGUN STAND

BACKGROUND OF THE INVENTION

1. Field of the Invention

The invention relates to the general field of sports equipment and more specifically to the field of sports equipment storage accessories.

2. Description of the Prior Art

Sportsmen who collect or use fire arms, as a general rule, take particularly good care of the weapons they own including the cleaning and storage aspects of responsible ownership. With regard to handguns, most owners keep their small guns locked in a secure location, and often owners will have a commercial safe in their home for the sole purpose of securing their handguns.

One of the inconveniences of storing handguns is that it is convention to store a handgun by laying it on its side. In some situations the gun is in the original case it was in when purchased, in other situations the gun is simply laid on a towel or blanket. Unfortunately, space in an affordable safe is generally limited and therefore storing handguns quickly uses the available space, leaving the active owner in a state of consternation.

Some typical methods of storing guns known to the Applicant are shown in U.S. Patents. For example, U.S. Pat. No. 3,468,508 issued Sep. 23, 1969 to Huver shows an interesting manner of storing a long gun by the barrel. Install the cup-shaped member over the barrel, and tighten the thumb screw and hang the gun in the closet or any other convenient location, failure to remove the cup before firing could create a dangerous condition. In 1990 a Design patent was issued to Southard, No. 310,302, Sep. 4, 1990, for a gun cradle which appears to be adapted for use with a long gun but with some modification could be designed to cradle a handgun. The U.S. Patent issued to Reinflied, Jr. et al, U.S. Pat. No. 4,971,208, dated Nov. 20, 1990 discloses a firearm support and it includes a support for both a handgun and a long gun. The purpose of the support is to make it convenient to repair and maintain the weapons. FIG. 4 illustrates the invention showing the barrel locked in clamp 20 and the butt in clamp 34. A U.S. Pat. No. 4,986,427 was granted to Law et al. on Jan. 22, 1991 for a storage rack for guns and other sporting equipment which is a rather typical style rack but lacks provision for the storage of small guns. A display stand for handguns is shown in U.S. Pat. No. 5,143,227 issued on Sep. 1, 1992 to Schubert. The stand is formed from plastic and contains a plurality of multangular slots designed to support a handgun in the area of the trigger guard, and allowing the gun to lean to the left giving the best viewing angle of the gun controls.

The prior art contains an interesting collection of gun stands and supports, however there still exists a need for a handgun stand that is suitable for storing guns in a confined area in a safe manner.

SUMMARY OF THE INVENTION

The invention is directed to a free standing hand gun stand that will support a number of different size handguns in a safe and convenient manner. The stand consists of a rectangular base member that will sit on a flat surface. A second, rectangular member is fixed to a longitudinal side of the base member at right angle to the surface of the base member. In the event the members are plastic the piece could be molded at a right angle. The second piece is a vertical plane relative to the horizontal plane of the base member. The second member contains a selected number of parallel vertical slots extending from the proximity of the base member to the proximity of top edge of the vertical member. Located on the side of the vertical member opposed from the base at each slot is a rectangular block including a rectangularly shaped appendage adapted to slide in the vertical slot and act as a follower. The appendage contains a threaded cavity for receiving a stud containing matching threads and a washer like stop ring positioned at the end of the threaded section of the stud. The stud engages the cavity from the base side of the vertical member through the slot and is thereby adjustable up and down to the limits of the slot. When the stud is at desired height it is simply tightened until the stop ring engages the face of the vertical member and the stud then becomes locked in place. The stud is adjusted for the size of the particular handgun. The barrel of the handgun slips over the stud and the base of the gun hand grip may either rest on the base member or not depending upon the owner choice.

It is therefore an object of the invention to provide a new and improved handgun stand.

It is another object of the invention to provide a new and improved handgun stand that will accept a number of hand guns.

It is a further object of the invention to provide a new and improved handgun stand that is compact and takes up little space.

It is still another object of the invention to provide a new and improved handgun stand that is easily moved from location to location.

It is still a further object of the invention to provide a new and improved handgun stand which is of a durable and reliable construction.

It is another object of the invention to provide a new and improved handgun stand which may be easily and efficiently manufactured ad marketed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
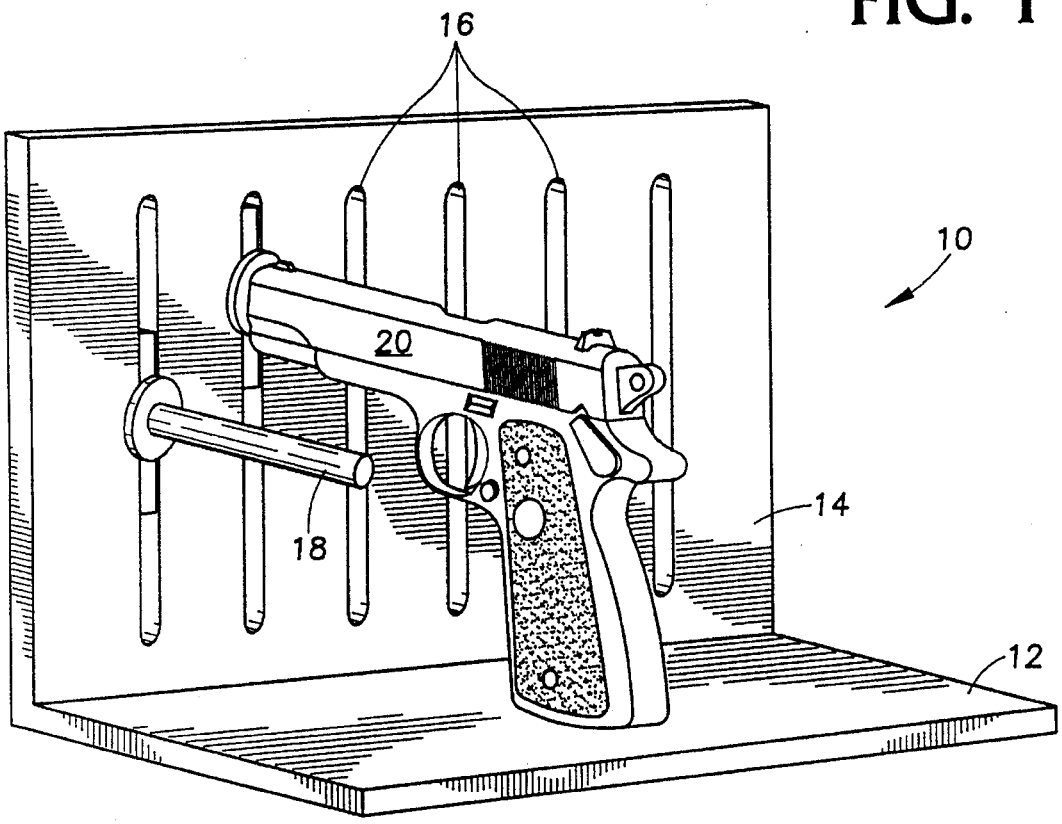
FIG. 1 is a perspective view of the invention.
Figure 3:
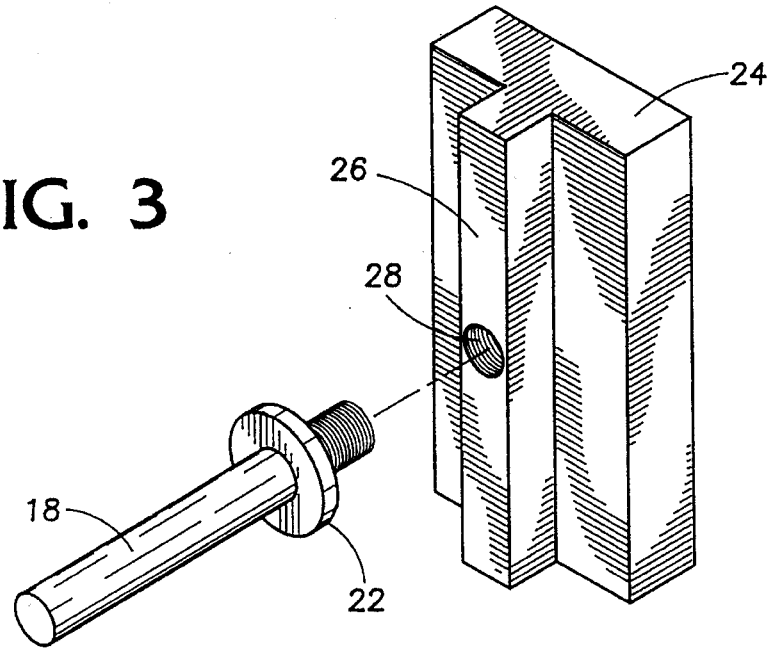
FIG. 3 is a perspective view of the stud and slot follower of the invention.
Figure 2:
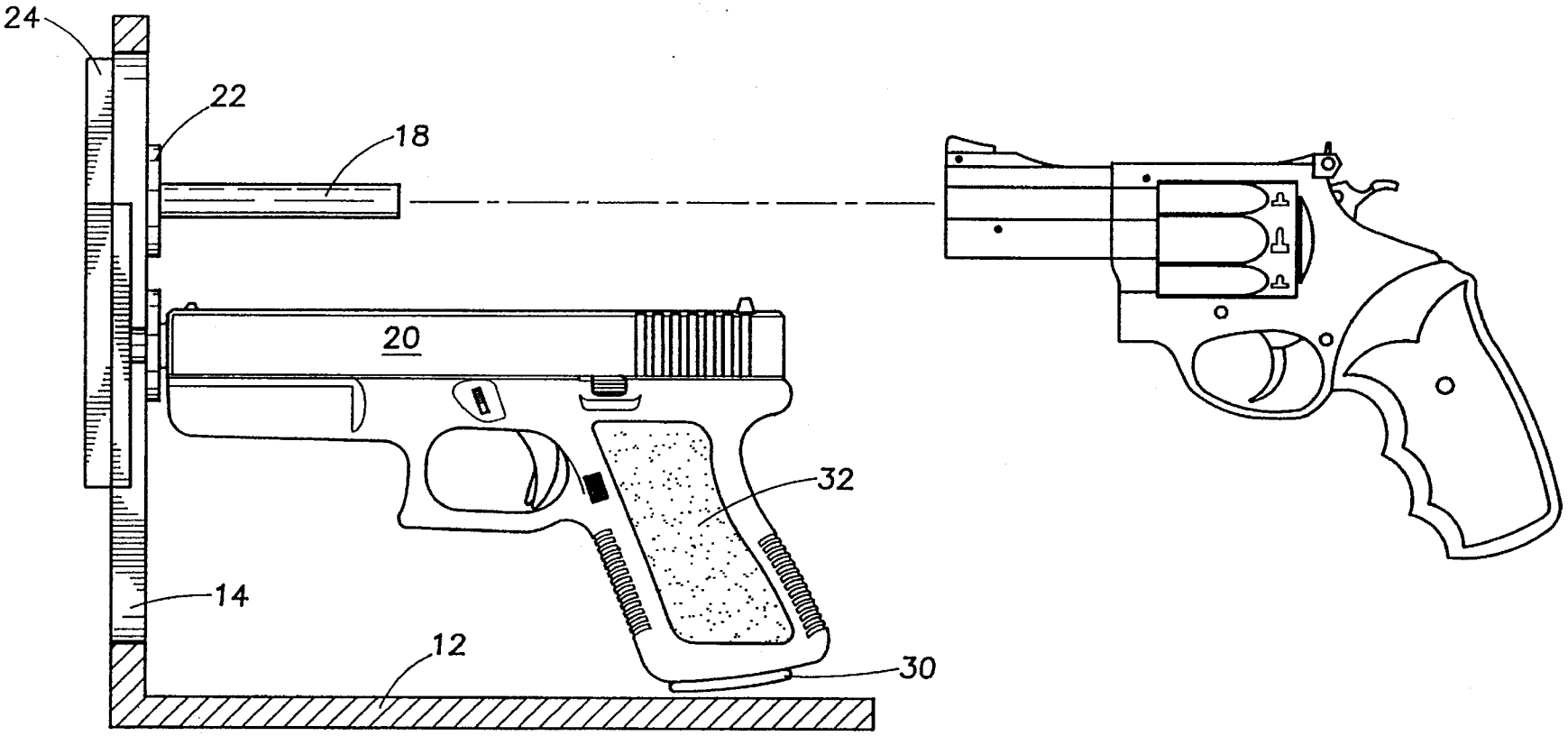
FIG. 2 is a side elevation view of the invention.

Referring now to FIG. 1 the handgun stand of the invention is shown generally at 10, consisting of a flat rectangular base 12 and a vertical member 14 abutting one longitudinal side of the base at a substantially right angle. The vertical member includes a plurality of slots 16. The number of slots is a matter of the designers choice and the size of the stand. Extending from the stand is a stud 18 which is of sufficient length and diameter to engage and support a handgun shown in the figure as 20. Concerning FIG. 2, the stud 18 contains a stop ring 22 which abuts the vertical member 14 when the stud engages the block 24 on the opposed side of the vertical member. The studs, which are formed of or coated with a material that is soft enough not to cause damage to the handgun, are vertically adjustable. The height adjustment of the stud will allow the owner to elect to let the heel 30 of the hand grip 32 rest on the base member or not. FIG. 3 shows the block 24 with the slot follower 26 having a threaded cavity 28 which accepts the threaded portion of stud 18. For adjustment and locking purposes the cavity is deeper than the threaded portion of the stud is long. In practice, the stud engages the follower loosely and adjusts to the desired height when it is tightened until the stop ring firmly engages the face of the vertical member and the stud is then ready to receive the handgun.

The diameter of the stud is only of casual importance in that the purpose of the stud is for support and is not meant to have a close fitting engagement with the barrels of the different caliber handguns.

The stand may be constructed from any appropriate material that is strong enough to carry the weight of the guns supported, including the finest imported wood, plastics and metals.

It should be understood, of course, that the foregoing disclosure relates to only a preferred embodiment of the invention and that numerous modification or alterations may be made therein without departing from the spirit and scope of the invention as set forth in the appended claims.

What I claim as my invention is:

1. A stand for storing handguns comprising: a first, flat rectangular panel forming a base; a second, flat rectangular panel forming a vertical panel , abutting one longitudinal side of the base panel, where the surfaces of the panels are at an angle of ninety degrees; a plurality of parallel slots in the vertical panel, extending from the proximity of the base to the proximity of the distal edge of the vertical panel; a follower member positioned on an opposed side of the vertical panel and adapted to ride in a slot; a stud means entering the slot from the base side of the vertical panel and engaging the follower member, and a stop ring on the stud means for engaging the vertical panel allowing the stud to be adjustable to different levels along the length of the vertical slot.

2. A stand for storing handguns according to claim 1 including: at least six vertical slots.

3. A stand for storing handguns according to claim 2 wherein: the follower includes a threaded cavity for receiving a stud.

4. A stand for storing handguns according to claim 3 wherein: the stud is threaded at one end for engagement with the threaded cavity of the follower member.

5. A stand for storing handguns according to claim 4 wherein: the stop ring is positioned on the stud between the threaded and the non threaded portion thereof.

6. A stand for storing handguns according to claim 5 wherein: the stand is formed of plastic material.

7. A stand for storing handguns according to claim 5 wherein: the stand is formed of a metal material.

* * * * *